US007665868B2

(12) United States Patent
Sato et al.

(10) Patent No.: US 7,665,868 B2
(45) Date of Patent: Feb. 23, 2010

(54) VEHICLE LAMP

(75) Inventors: Koji Sato, Tokyo (JP); Daisuke Nagafuchi, Tokyo (JP); Nobuyuki Suzuki, Tokyo (JP)

(73) Assignee: Stanley Elecrtric Co., Ltd., Tokyo (JP)

( * ) Notice: Subject to any disclaimer, the term of this patent is extended or adjusted under 35 U.S.C. 154(b) by 0 days.

(21) Appl. No.: 12/140,585

(22) Filed: Jun. 17, 2008

(65) Prior Publication Data

US 2008/0316757 A1 Dec. 25, 2008

(30) Foreign Application Priority Data

Jun. 20, 2007 (JP) ..... 2007-162022

(51) Int. Cl.
*F21V 29/00* (2006.01)

(52) U.S. Cl. ..... 362/373; 362/294; 362/345

(58) Field of Classification Search ..... 362/218, 362/264, 294, 345, 346, 373, 547
See application file for complete search history.

(56) References Cited

U.S. PATENT DOCUMENTS 4,799,131 A * 1/1989 Aho et al. ..... 362/348
6,450,670 B1 * 9/2002 Strauss et al. ..... 362/345
7,249,868 B2 * 7/2007 Chinniah et al. ..... 362/547
7,258,465 B2 * 8/2007 Morinaga ..... 362/373
2009/0059594 A1 * 3/2009 Lin ..... 362/294

FOREIGN PATENT DOCUMENTS

JP 4004503 1/1992

* cited by examiner

*Primary Examiner*—Y My Quach Lee
(74) *Attorney, Agent, or Firm*—Cermak Kenealy Vaidya & Nakajima LLP

(57) ABSTRACT

The disclosed subject matter can include a vehicle lamp having a favorable light distribution and an effective heat dissipation structure. The vehicle lamp can include a light source and a casing in which the light source is sealed. The casing can be configured in a tubular shape and a reflector can be configured in a hollow of the casing. The casing can be sealed between the reflector and a front lens configured to allow light emitted from the light source to pass therethrough. The inner surfaces of the casing and the reflector can be configured to form a predetermined light distribution via the front lens. The outer surfaces of the casing and the reflector can be exposed to the outside and can be configured to radiate heat generated from the light source to the outside using heat conductive material. Thus, the lamp can be miniaturized and provide favorable light distribution.

14 Claims, 4 Drawing Sheets

VEHICLE LAMP

This application claims the priority benefit under 35 U.S.C. §119 of Japanese Patent Application No. 2007-162022 filed on Jun. 20, 2007, which is hereby incorporated in its entirety by reference.

BACKGROUND

1. Field

The presently disclosed subject matter relates to a vehicle lamp that includes a light source and a casing in which the light source is sealed, and more particularly to a vehicle lamp further including a heat dissipation structure that can prevent the casing and other components from experiencing thermal damage.

2. Description of the Related Art

A vehicle can include various vehicle lamps such as a headlight, a taillight, a stop lamp, a position lamp, a turn-signal lamp and the like, which include a light source such as an incandescent bulb, a halogen bulb, a high-intensity discharge lamp, an LED lamp, etc. Some vehicle lamps include a casing and other components such as a reflector, an outer lens and the like as necessary so that the light distribution thereof can conform to a light distribution standard.

In general, there has been a desire to miniaturize vehicle lamps in order for passengers to maintain a comfortable amount of space and in order to provide space for cargo, engine components, design features, etc. Thus, the casing including the light source, the reflector and the like can be miniaturized. In addition, because the miniaturized casing includes a light source that gives out heat in the small sealed casing, positioning for a heat dissipation structure in the vehicle lamp is a major issue as well as a configuration of the vehicle lamp to conform to a light distribution standard.

Because, if the heat dissipation structure cannot normally operate, the casing and other components such as the reflector may deteriorate, transform and/or tarnish. Accordingly, the vehicle lamp may not be able to conform to a light distribution standard and also may become unable to operate.

An exemplary embodiment of the conventional vehicle lamp including a heat dissipation structure is disclosed in patent document No. 1 (Japanese Patent Application Laid Open H04-004503). FIG. 3 is a schematic side cross-section view showing an exemplary structure of this conventional vehicle lamp. A vehicle lamp 1 shown in FIG. 3 is a rear combination lamp that can include a stop lamp, a taillight, a position lamp, a turn-signal lamp, etc.

The vehicle lamp 1 includes a casing 2, a bulb 3, a reflector 4, a front lens 5 and a heat-insulating board 6. The casing 2 that fixes components of the vehicle lamp 1 is open in a direction towards a light-emission of the vehicle lamp 1. The bulb 3 that is used as a light source for the vehicle lamp 1 is located in the reflector 4. The reflector 4 reflects light emitted from the bulb 3 in the direction towards the light-emission of the vehicle lamp 1.

The front lens 5 is composed of a transparent resin and is attached to the casing 2 so as to cover the front open area thereof. The heat-insulating board 6 is located at an upper portion of the reflector 4. The casing 2 is composed of an opaque material such as a resin, a metal and the like, and seals both the bulb 3 and the reflector 4 with the front lens 5. The reflector 4 is located only around the bulb 3 as shown in FIG. 3, however, the reflector 4 may be actually located around other bulbs for other lamps included in the rear combination lamp.

The bulb 3 can be a halogen bulb and the like, having an optical axis located parallel with respect to the direction of light-emission for the vehicle lamp 1. The bulb 3 is attached to a socket 3*a* and receives a power supply via the socket 3. The reflector 4 is composed of a resin and the like, and an inner surface thereof is configured with a parabolic surface in order to reflect light emitted from the bulb 3 in a direction towards the front lens 5.

The front lens 5 is composed of a transparent material in order to allow the above-described reflex light to pass in the direction of light-emission of the vehicle lamp 1. The front lens 5 is attached to the casing 2 so as to be able to seal the open area of the casing 2. Therefore, both the casing 2 and the front lens 5 can result in a hermetic inner space for the vehicle lamp 1.

The heat-insulating board 6 is composed of a high thermal conductive material such as a metallic plate and the like. The heat-insulating board 6 is located along an inner surface of the reflector 4 and contacts an upper portion 4*b* of the reflector 4. The heat-insulating board 6 is attached to the rear of the reflector 4 by screwing a rear end portion 6*a* thereof with a screw 6*b* after it is inserted into an inside of the casing 2 from a backward direction of the reflector 4 via a slot 4*c*, which is located near an upper rear of the reflector 4.

According to the vehicle lamp 1 of the above-described structure, when the bulb 3 receives the power supply and emits light, both the direct light emitted from the bulb 3 and the reflex light reflected from the reflector 4 is emitted ahead in the light-emission direction of the vehicle lamp 1 via the front lens 5.

In that case, heat generated from the bulb 3 produces an increase in temperature of air around the bulb 3 located in the reflector 4. Because the hot air expands and a specific gravity thereof becomes light, the hot air moves upwards in a direction towards the upper portion 4*b* of the reflector 4. Thus, the hot air heats up the upper portion 4*b* of the reflector 4.

However, because the heat-insulating board 6 is located underneath the upper portion 4*b* of the reflector 4, the heat-insulating board 6 can prevent the upper portion 4*b* from thermal damage caused by the hot air. Thus, the upper portion 4*b* of the reflector 4 may not deteriorate or transform and/or tarnish due to the heat generated from the bulb 3.

FIGS. 4(A) and (B) are a schematic perspective view and a schematic side cross-section view showing another exemplary structure of a conventional vehicle lamp, respectively. In the following description with reference to FIGS. 4(A) and (B), the same or corresponding elements as shown and described with reference to FIG. 3 use the same reference marks as reference marks used in the above description of FIG. 3, and their operation and description are abridged in the following description.

According to a vehicle lamp 7 shown in FIGS. 4(A) and (B), a pair of ribs 2*b* is located underneath an upper portion of a casing 2, and a heat-insulating board 6 can be inserted between the pair of ribs 2*b* from a direction of a front lens 5. Thus, because the heat-insulating board 6 can be sandwiched between the pair of ribs 2*b* and attached to the casing 2, the heat-insulating board 6 can prevent the upper portion of the casing 2 from thermal damage caused by heat generated from bulb 3.

In the above-described vehicle lamps 1 and 7, because their heat-insulating boards 6 are located underneath the upper portions of the reflector 4 and the casing 2, respectively, the heat-insulating boards 6 may be seen from outside of the vehicle lamps via their front lenses 5. Therefore, their outside appearance may not look very good and/or maybe limited with respect to design creativity.

In addition, when reflectors 4 extend in their upwards directions in order to conform to a light distribution standard, it may be difficult or even impossible to extend these reflectors 4 upwards. Furthermore, if heat-insulating boards 6 receive a part of the light emitted from bulbs 3, this unexpected incoming light may be emitted to the outside via front lenses 5.

In the vehicle lamp 7 shown in FIGS. 4(A) and (B), because the pair of ribs 2*b* is located underneath the upper portion of the casing 2, when the pair of ribs 2*b* receives a part of light emitted from the bulb 3, the unexpected light may be emitted to the outside via the front lens 5. Thus, the above-described unexpected light may cause a problem and may not conform to a predetermined light distribution pattern.

In an assembling process of the vehicle lamp 1 shown in FIG. 3, the heat-insulating board 6 is inserted into the inside of the casing 2 from the backward direction of the reflector 4 via the slot 4*c*. In this case, turnings or shavings may occur due to an edge of the heat-insulating board 6 rubbing against the reflector 4 during insertion and/or from the screw process itself. Similarly, in an assembling process of the vehicle lamp 7, the heat-insulating board 6 is inserted between the pair of ribs 2*b* from the direction towards a front lens 5 and is fixed at a predetermined position. In this case, turnings or shavings may likewise occur due to an edge of the heat-insulating board 6.

The above-described turnings or shavings may frequently fall down from the slot 4*c* and the pair of ribs 2*b* in the reflector 4 and/or the casing 2. Thus, these turnings and/or shavings may cause a defect in the vehicle lamps 1 and 7. Moreover, the above-described heat-dissipation structure cannot basically lose the hot air to the outside of the casing 2 but can lose the hot air in the casing 2. Thus, when the hermetic inner space of the casing 2 is small and the bulb continuously emits for a long time, the vehicle lamp may not be configured properly to prevent the casing 2 and other components from experiencing thermal damage caused by the heat generated from the bulb 3.

The above-referenced Patent Documents are listed below.

1. Patent document No.1: Japanese Patent Application Laid Open H04-004503

The disclosed subject matter has been devised to consider the above and other problems, characteristics and features. Thus, an embodiment of the disclosed subject matter can include a vehicle lamp including a light source and a casing in which the light source is sealed, wherein a feature of the vehicle lamp can include providing a heat dissipation structure that can prevent the casing and other components from experiencing thermal damage. The heat dissipation structure can radiate the heat generated by the light source to the outside of the casing while it can be hidden from the outside of the vehicle lamp. In addition, an attachment thereof can be simple. Because the heat-insulating portion of the above-described structure can be used as a reflex surface, the heat dissipation structure can result in a small vehicle lamp having a favorable light distribution.

SUMMARY

The presently disclosed subject matter has been devised in view of the above and other characteristics, desires, and problems in the conventional art, and to make certain changes to existing vehicle lamps. Thus, an aspect of the disclosed subject matter includes providing a vehicle lamp including a light source and a casing in which the light source is sealed, wherein a feature of the vehicle lamp can include providing a heat dissipation structure that can prevent the casing and other components from experiencing thermal damage. In addition, because an inner surface of the casing can be used as a reflex surface adjacent a reflector, the heat dissipation structure can result in a small vehicle lamp having a favorable light distribution.

According to another aspect of the disclosed subject matter, a vehicle lamp can include a light source, a reflector, a front lens, a casing and a thermal conductive material. The reflector can be configured in a hollow having both an inner surface and an outer surface, and can reflect light emitted from the light source on the inner surface thereof in a direction towards a light-emission of the vehicle lamp while holding the light source. The front lens can be configured to pass through both the light emitted from the light source and the reflex light reflected from the reflector. The casing can be configured in a tubular shape having both an inner surface and an outer surface to be sealed between the front lens and the reflector. The thermal conductive material can be configured to contact at least one of the outer surface of the reflector and the outer surface of the casing while being attached to the casing and/or the reflector.

In the above-described exemplary vehicle lamp, both the light emitted from the light source and the reflex light reflected from the reflector can be emitted ahead in the direction of light-emission for the vehicle lamp via the front lens. In this case, while heat generated from the light source can radiate from the exposed reflector to an outside of the vehicle lamp, hot air caused by the light source can radiate from the thermal conductive material to the outside via at least one of the outer surface of the reflector and the outer surface of the casing. Thus, the heat dissipation structure can radiate the heat caused by the light source to the outside of the casing while it is hidden from the outside of the vehicle lamp.

In the above-described heat dissipation structure, the thermal conductive material can be configured with a metallic material and the at least one of the outer surface of the reflector and the outer surface of the casing which contacts the thermal conductive material can be a surface configured to form a V-shaped groove so as to enlarge in a direction towards the reflector. In addition, the thermal conductive material can be configured to be formed platy including a ridged structure and can be configured to adhere in the V-shaped groove with an elasticity of the ridged structure thereof.

In the above-described exemplary vehicle lamp, the thermal conductive material can improve heat-radiating efficiency by using a metallic material with high conductivity and can further improve heat-radiating efficiency by increasing a heat-radiating area thereof with the ridged structure. In addition, because the thermal conductive material can adhere between the V-shaped groove with an elasticity of the ridged structure thereof by being inserted into the V-shaped groove, the attachment of the heat dissipation structure can be extremely simple.

In the above-described exemplary vehicle lamp, the reflector can be configured to be formed integrally with the casing and the inner surface of the casing can be configured to include a reflex surface for reflecting the light emitted from the light source. The reflex surface on the inner surface of the casing can be formed adjacent to the reflector. Thus, the vehicle lamp including the heat dissipation structure of the disclosed subject matter can result in a small vehicle lamp having a favorable light distribution.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
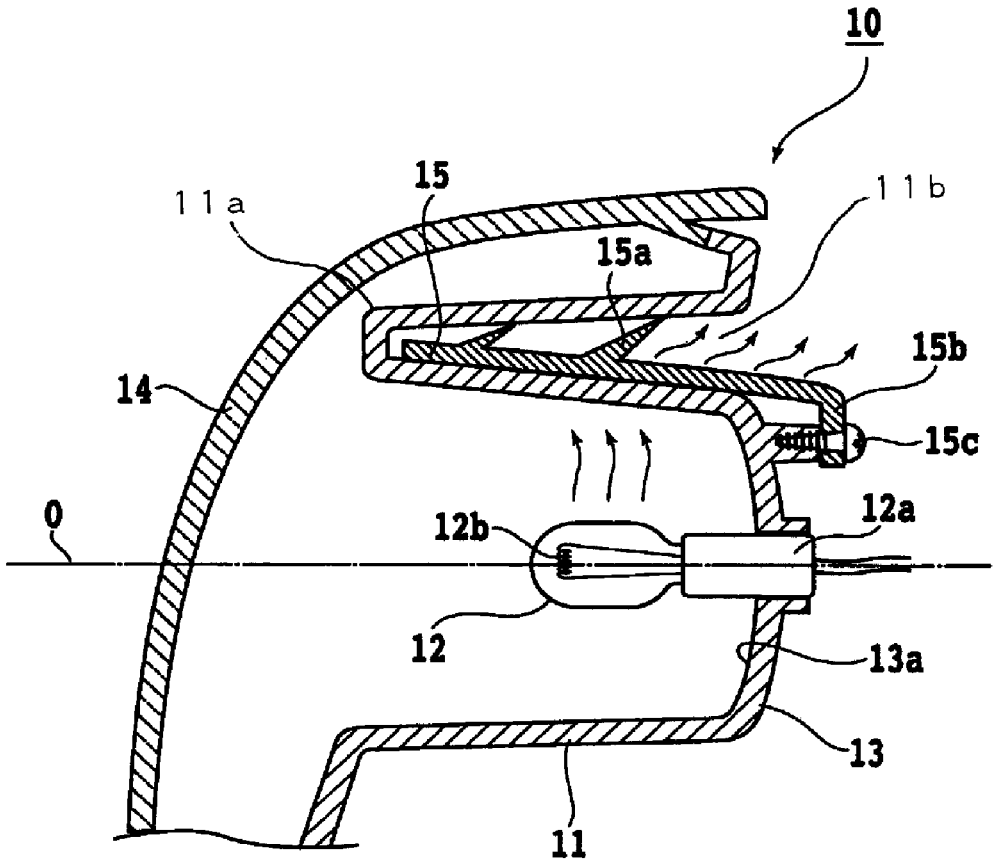
FIG. 1 is a schematic side cross-section view of an exemplary embodiment of a vehicle lamp made in accordance with principles of the disclosed subject matter.

The disclosed subject matter will now be described in detail with reference to FIGS. 1 to 2. FIG. 1 is a schematic side cross-section view of an exemplary embodiment of a vehicle lamp made in accordance with principles of the disclosed subject matter. The vehicle lamp 1 shown in FIG. 1 is a rear combination lamp that can include a stop lamp, a taillight, a position lamp, a turn-signal lamp, etc.

The vehicle lamp 1 is not limited to a rear combination lamp and can alternatively be configured as a lamp including at least one of a headlight, a taillight, a positioning light, running light, fog light, traffic light, or other vehicle related lamp, etc.

The vehicle lamp 10 can include a casing 11, a light source 12, a reflector 13, a front lens 14 and a thermal conductive material 15. The casing 11 can be configured in a tubular shape having both an inner surface and an outer surface. The light source 12 can be included in the reflector 13 that can be composed of a resin, a metal, etc.

The reflector 13 can be configured in a hollow having both an inner surface and an outer surface, and can be configured to reflect light emitted from the light source 12 on the inner surface of the reflector 13 in a direction of light-emission for the vehicle lamp 10.

The front lens 14 can be composed of a translucent resin or other transparent material and therefore can be configured to allow both direct light emitted from the light source and reflex light reflected from the reflector 13 to pass therethrough. The casing 11 can be composed of an opaque material such as a resin, a metal and the like, and when using the resin, a thermal conductive resin can be used as will be described later.

The casing 11 can be sealed between the front lens 14 and the reflector 13 and can include the light source 12. Thus, an inner space of the casing 11 that is closed by both the front lens 14 and the reflector 13 can maintain a hermetic seal with respect to the outside. Sealing methods can be employed such as using an adhesive material seal, welding, etc.

The thermal conductive material 15 can be configured to contact at least one of the outer surface of the reflector 13 and the outer surface of the casing 11 while being attached to the casing 11 and/or the reflector 13. The attachment of the thermal conductive material 15 will be described in detail later.

The casing 11 can be configured to include both a projecting portion 11*a* and a groove 11*b*. The projecting portion 11*a* of the casing 11 can be configured to stretch from a rear portion of the casing 11 in the direction towards light-emission of the vehicle lamp 10 so as to form a groove with an outer surface thereof. Thus, an inner surface of the projecting portion 11*a* can be used as a reflex surface that can reflect the light emitted from the light source 12 along with the reflector 13, and light use efficiency of the light source 12 can improve in this case.

The groove 11*b* can be the groove that is formed by the both outer surfaces of the projecting portion 11*a* so as to enlarge towards the reflector 13. Thus, a side cross-section view of the groove 11*b* can be substantially V-shaped being open towards the reflector 13. In an alternate embodiment, a surface of the groove 11*b* can be provided with a pair of ribs similar to the ribs for fixing the thermal conductive material 15 in some cases. However, because the fixing method using the ribs may result in the thermal conductive material 15 moving by a vibration of the vehicle, the thermal conductive material 15 can alternatively be attached with an adhesive and the like.

The light source 12 is a light-emitting device for the vehicle lamp 10 such as a rear combination lamp, a stop lamp, a taillight, a headlight, etc. For example, a halogen bulb can be used as the light source 12, of which optical axis can be located parallel in direction and towards the light-emission direction of the vehicle lamp 10. Therefore, the predetermined light distribution pattern can be formed by both a formation of the reflector 13 and a surface shape of the front lens 14 using the light source 12.

The light source 12 can be attached to a socket 12*a* and can receive a power supply via the socket 12*a*. In this case, because the socket 12*a* can be attached to the reflector 13 exposing the outer surface thereof to the outside, a part of the heat generated from the light source 12 can radiate from the reflector 13 to the outside of the vehicle lamp 10 via the socket 12*a*.

The reflector 13 can be configured to be formed integrally with the casing 11 using a resin and the like, and can be also configured to include the inner surface of the casing 11 as the adjacent reflector. Thus, a reflex surface 13*a* of the reflector 13 can reflect the light emitted from a light-emitting element 12*b* of the light source 12 along with the reflex surface of the casing 11 in the light-emission direction of the vehicle lamp 10.

The above-described reflex surface of the casing 11 can be formed at a voluntary position and in an arbitrary shape in accordance with the predetermined light distribution of the vehicle lamp 10. For instance, the reflex surfaces can be parabolic in order to be able to form the predetermined light distribution pattern via the front lens 14.

The thermal conductive material 15 can be composed of a material having a high thermal conductivity such as a metal and the like, and can be formed in a platy configuration. The thermal conductive material 15 can also be configured to include a ridged structure 15*a* thereon. The ridged structure 15*a* can be configured to bulge obliquely upwards in the direction towards the rear portion of the casing 11 as shown in FIG. 1.

When the thermal conductive material 15 is inserted into the groove 11*b*, it can contact an upper surface of the groove 11*b* using an elastic deformation of the ridged structure 15*a*. Then a bottom surface of the thermal conductor material 15 can contact and adhere to an under surface of the groove 11*b* with the elasticity of the thermal conductive material 15 so as not to move from the groove 11*b* rearwards. Consequently, the thermal conductive material 15 including the ridged structure 15*a* may not require an adhesive process and may rely on only the fixing method using the ribs.

Figure 2:
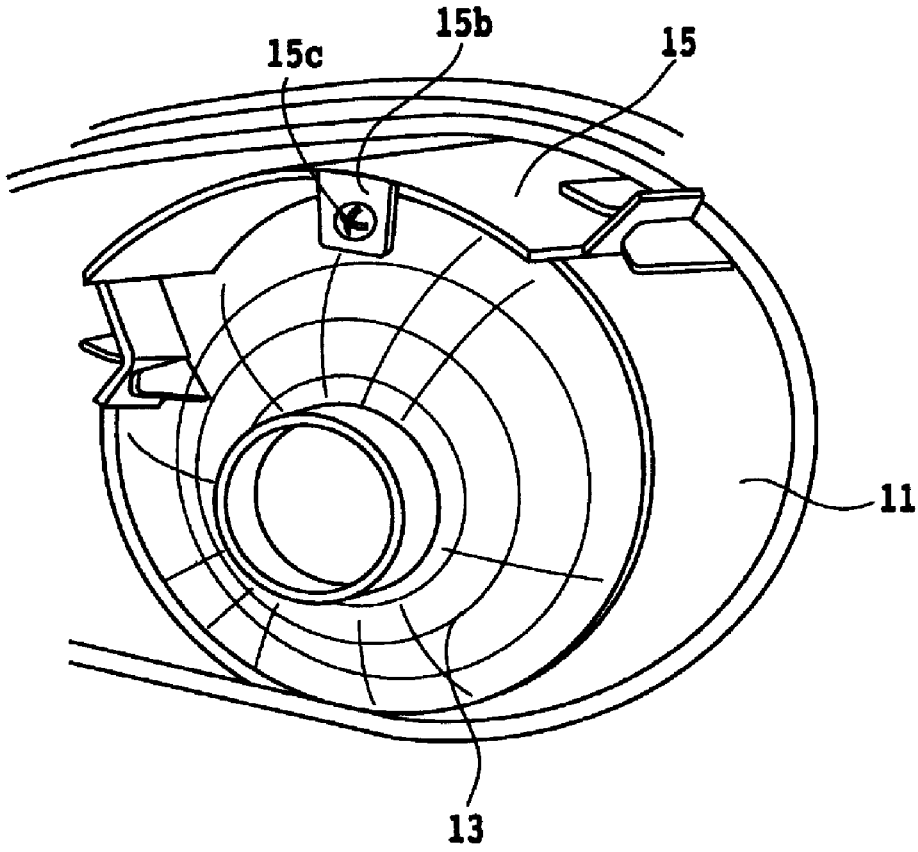
FIG. 2 is a schematic rear perspective view depicting the vehicle lamp shown in FIG. 1.
Figure 3:
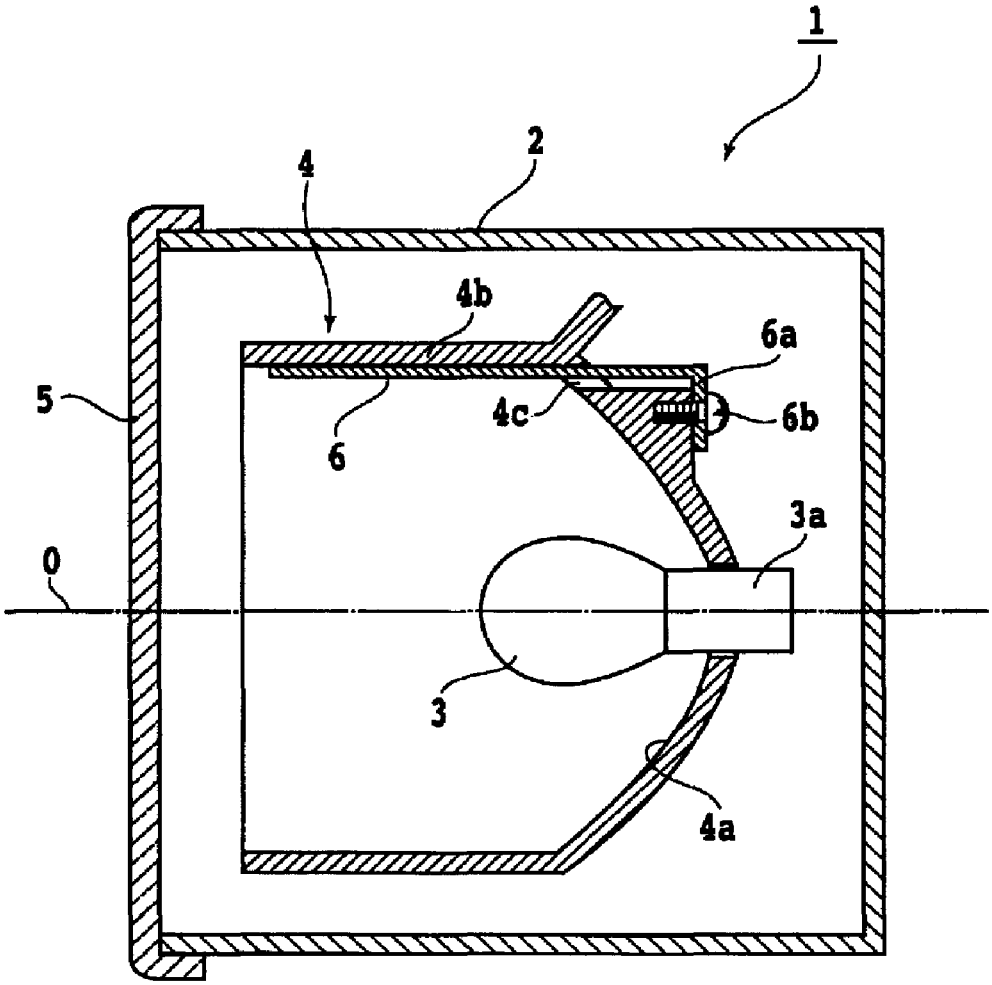
Fig. 3 Conventional Art
FIG. 3 is a schematic side cross-section view showing an exemplary structure of a conventional vehicle lamp.

FIG. 2 is a schematic rear perspective view depicting the vehicle lamp shown in FIG. 1. The thermal conductive material 15 can be inserted into the groove 11*b* from the direction towards the reflector 13 as shown in FIG. 2. Then the thermal conductive material 15 can be attached to the casing 11 or the reflector 13 by screwing a rear end 15*b* thereof with a screw 15*c*. In this case, the thermal conductive material 15 can include a projecting portion from the groove 11*b*. The projecting portion of the thermal conductive material 15 can improve a heat-radiating efficiency due to increasing an exposed area to the outside of the vehicle lamp 10.

When the light source 12 receives a power supply via the socket 12*a* and emits light, both the direct light emitted from the light source 12 and the reflex light reflected from the reflector can be emitted with the predetermined light distribution pattern in the light-emission direction of the vehicle lamp 10 via the front lens 14.

In this case, the heat generated from the light source 12 can efficiently radiate from the reflector 13 to the outside of the vehicle lamp 10 via the socket 12*a* because the reflector 13 can be exposed to the outside unlike the heat-insulating structure of the conventional vehicle lamp. On the other hand, the hot air generated due to the increase of temperature of air around the light source 12 expands and moves upwards in the direction towards the upper portions of the casing 11 and the reflector 13 where the projecting portion 11*a* of the casing 11 is located.

The projecting portion 11*a* of the casing 11 is heated by the hot air, however, the thermal conductive material 15 can contact the outer surface opposite the projecting portion 11*a*. Thus, the heat of the projecting portion 11*a* heated by the hot air can transmit via the thermal conductive material 15 and can radiate from the thermal conductive material 15 to the outside of the vehicle lamp 10. Because the thermal conductive material 15 can be exposed to the outside, unlike the heat-insulating structure of the conventional vehicle lamp, the heat generated by the hot air does not radiate in the casing but can radiate to the outside of the casing 11 of the vehicle lamp 10.

In this case, when at least one of the casing 11 and the reflector 13 is in contact with the thermal conductive material 15, the heat-radiating efficiency can improve because the above-described heat can easily transmit via the thermal conductive material 15. The thermal conductive material 15 can include a metal, a thermally conductive resin, etc.

In addition, when the thermal conductive material 15 includes the projecting portion from the groove 11*b*, the heat transmitted via the thermal conductive material 15 does not stay in the groove 11*b* but can easily radiate to the outside of the vehicle lamp 10 because of the increased exposed area to the outside. Thus, the large projecting portion of the thermal conductive material 15 can improve the heat-radiating efficiency.

According to the heat dissipation structure as described above, because the heat caused by the light source 12 can reliably radiate to the outside of the vehicle lamp 10, the heat dissipation structure can prevent the casing 11 and the other components therein from thermal damage even if the casing 11 is small.

The thermal conductive material 15 of the heat dissipation structure can be located on the outer surface of the casing 11 and/or the reflector 13. Therefore, because the thermal conductive material 15 cannot be seen from the outside, as compared to the heat-insulating structure of the conventional vehicle lamp, the vehicle lamp can have an outside appearance thereof that can have greater design flexibility.

Similarly, the light emitted from the light source 12 cannot be absolutely reflected on the thermal conductive material 15. Thus, the thermal conductive material 15 cannot cause a problem in the light distribution pattern that is emitted via the front lens 14 such as that caused by the unexpected light in the light distribution pattern of the heat-insulating structure of the conventional vehicle lamp.

Figure 4A:
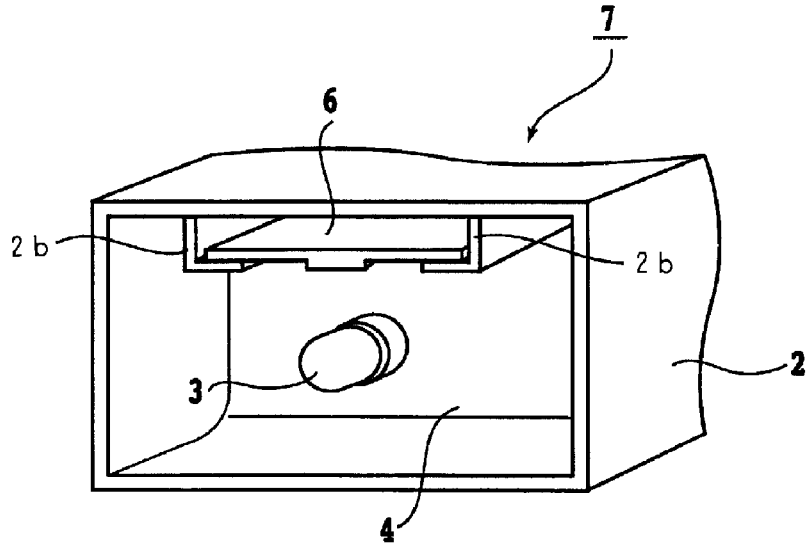
Fig. 4(A) Conventional Art
FIGS. 4(A) and (B) are a schematic perspective view and a schematic side cross-section view showing another exemplary structure of a conventional vehicle lamp, respectively.
Figure 4B:
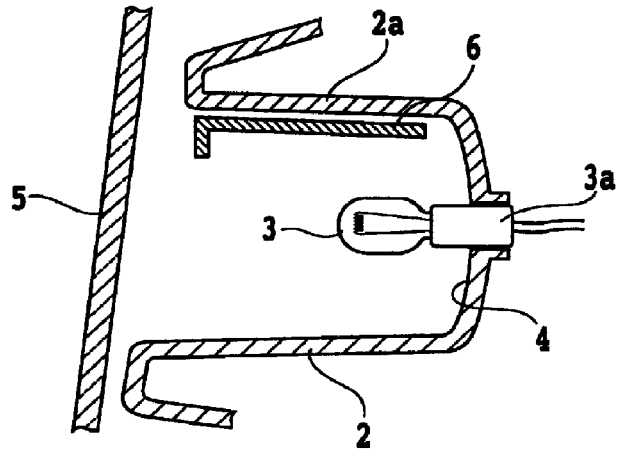
Fig. 4(B) Conventional Art

In addition, even if a pair of ribs similar to the ribs shown in FIG. 4 is provided on the outer surface of the casing 11 for fixing the thermal conductive material 15 therebetween and turnings or shavings occur due to an edge of the thermal conductive material 15, the turnings or shavings cannot fall down in the casing 11 and/or the reflector 13. If the turnings or shavings fall down, they will fall down to the outside of the vehicle lamp 10, and therefore cannot cause a defect in the vehicle lamp 10.

As described above, the vehicle lamp 10 can include both the casing 11 and the reflector 13, wherein the both inner surfaces can be used as a reflex surface and both outer surfaces can be exposed to the outside of the vehicle lamp 10. Thus, both inner surfaces can form a favorable light distribution pattern along with the front lens 14 in accordance with various usages of the vehicle lamp 10.

In addition, both outer surfaces can be exposed to the outside and can be used as heat dissipation structure. At least one of the outer surfaces can contact the thermal conductive material 15. The thermal conductive material 15 can contact at least on of the outer surfaces at a voluntary position and in an arbitrary shape. Consequently, a small vehicle lamp having a favorable light distribution can be provided.

Furthermore, the attachment of the thermal conductive material 15 can be extremely simple as described above and the heat dissipation structure of the vehicle lamp can be hidden from the outside of the vehicle lamp 10. Thus, the vehicle lamp 10 can have a beautiful outside appearance.

Various modifications of the above disclosed embodiments can be made without departing from the spirit and scope of the presently disclosed subject matter. For example, the vehicle lamp can include a plurality of lamps using the above-described heat dissipation structure. In addition, each of the plurality of lamps can be used for respective usages having respective light distribution patterns.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A vehicle lamp having an optical axis and a light emission direction extending along the optical axis, comprising:

a light source;

a reflector having both an inner surface and an outer surface, the light source located adjacent the reflector, and the inner surface of the reflector configured to reflect light emitted from the light source towards the light-emission direction of the vehicle lamp;

a front lens configured to allow both light emitted from the light source and light reflected from the reflector to pass through;

a casing configured in a tubular shape having both an inner surface and an outer surface, the casing being sealed between the front lens and the reflector; and a thermal conductive material configured to contact at least one of the outer surface of the reflector and the outer surface of the casing, and attached to at least one of the casing and the reflector, the thermal conductive material having a surface facing towards the light source, wherein a majority of the surface facing towards the light source contacts at least one of the casing and the reflector, and the at least one of the outer surface of the reflector and the outer surface of the casing which is configured to contact the thermal conductive material is formed as a V-shaped groove in cross-section when viewed in a direction perpendicular to the optical axis, the V-shaped groove enlarging as the groove approaches the reflector.

2. The vehicle lamp according to claim 1, wherein the thermal conductive material includes a metallic material.

3. The vehicle lamp according to claim 1, wherein the reflector is integrally formed with the casing.

4. The vehicle lamp according to claim 3, wherein the thermal conductive material is configured in a plate-like shape and includes a ridged structure extending from the plate-like shape.

5. The vehicle lamp according to claim 3, wherein the thermal conductive material is configured in a plate-like shape and includes a ridged structure extending from the plate-like shape and is located in the V-shaped groove, the ridged structure having an elasticity such that the thermal conductive material is frictionally adhered in the V-shaped groove by the ridged structure.

6. The vehicle lamp according to claim 3, wherein the inner surface of the casing includes a reflex surface configured to reflect light emitted from the light source.

7. The vehicle lamp according to claim 3, wherein the inner surface of the casing is substantially hollow and tubular in shape and includes a lens at a first open end of the tubular shape and a reflex surface at a second end opposing the first open end.

8. The vehicle lamp of claim 7, wherein the reflex surface includes a reflective coating configured to reflect light emitted from the light source.

9. The vehicle lamp according to claim 1, wherein the thermal conductive material is configured in a plate-like shape and includes a ridged structure extending from the plate-like shape.

10. The vehicle lamp according to claim 1, wherein the thermal conductive material is configured in a plate-like shape and includes a ridged structure extending from the plate-like shape and is located in the V-shaped groove, the ridged structure having an elasticity such that the thermal conductive material is frictionally adhered in the V-shaped groove by the ridged structure.

11. A vehicle lamp having an optical axis and a light emission direction extending along the optical axis, comprising:

a light source;

a reflector having both an inner surface and an outer surface, the light source located adjacent the reflector, and the inner surface of the reflector configured to reflect light emitted from the light source towards the light-emission direction of the vehicle lamp;

a front lens configured to allow both light emitted from the light source and light reflected from the reflector to pass through;

a casing configured in a tubular shape having both an inner surface and an outer surface, the casing being sealed between the front lens and the reflector; and a thermal conductive material configured to contact at least one of the outer surface of the reflector and the outer surface of the casing, and attached to at least one of the casing and the reflector, the thermal conductive material having a surface facing towards the light source, wherein a majority of the surface facing towards the light source contacts at least one of the casing and the reflector, wherein the inner surface of the casing includes a reflex surface configured to reflect light emitted from the light source, and the reflector holds the light source.

12. A vehicle lamp having an optical axis and a light emission direction extending along the optical axis and away from the vehicle lamp, comprising:

a light source;

a casing having an inner surface and an outer surface and being formed in a substantially tubular shape about the optical axis of the lamp with a substantially open front portion and a substantially closed rear portion, the light source located adjacent a reflector portion of the inner surface at the rear portion of the casing, and the reflector portion configured to reflect light emitted from the light source towards the light-emission direction and along the optical axis of the vehicle lamp, the casing including, a first portion extending away from the reflector portion and in the light emitting direction to a distal position with respect to the reflector portion, and a second portion extending from the distal position in a direction above the first portion and opposite the light emitting direction to a proximal position, wherein the first portion of the casing and second portion of the casing form a groove located above the light source, the groove expanding in a direction normal to the optical axis and along a direction opposite the light emission direction of the vehicle lamp;

a thermal conductive material located in and in contact with the groove in the casing; and a front lens located adjacent the casing opposite to the reflector portion and configured to allow both light emitted from the light source and light reflected from the reflector portion to pass though.

13. The vehicle lamp of claim 12, wherein the thermal conductive material is formed as a plate shaped structure and includes protrusions extending from a top surface of the plate shaped structure, the protrusions contacting the groove.

14. The vehicle lamp of claim 12, wherein the thermal conductive material extends along and is in contact with the casing from the distal position to the proximal position.

* * * * *